United States Patent [19]

Appelkvist et al.

[11] Patent Number: 5,033,195

[45] Date of Patent: Jul. 23, 1991

[54] PLIERS JAWS FOR CUTTING MATERIALS WITH DIFFERENT HARDNESS AND DIMENSIONS

[75] Inventors: Rolf Appelkvist; Hans Bergström; Lars Erlandsson, all of Eskilstuna, Sweden

[73] Assignee: F E Lindström AB, Eskilstuna, Sweden

[21] Appl. No.: 541,587

[22] Filed: Jun. 21, 1990

[30] Foreign Application Priority Data

Jul. 5, 1989 [SE] Sweden ..... 8902446

[51] Int. Cl.[5] ..... B26B 13/00; B26B 17/00; B26B 7/22

[52] U.S. Cl. ..... 30/254; 30/175; 7/130

[58] Field of Search ..... 30/239, 244, 254, 266, 30/175, 186; 7/128, 129, 130, 132, 133, 125, 130; 76/64, 69

[56] References Cited

U.S. PATENT DOCUMENTS

| | | | |
|---|---|---|---|
| 603,349 | 5/1898 | Toward | 7/130 |
| 898,496 | 9/1980 | Mullenbach | 7/133 |
| 2,830,367 | 4/1958 | Seymour | 7/130 |
| 2,885,781 | 5/1959 | Bauer | 30/254 |
| 2,990,735 | 7/1961 | Manning . | |
| 3,461,555 | 8/1969 | Bliznak | 30/254 |
| 3,901,293 | 8/1975 | Cottone | 7/133 |

FOREIGN PATENT DOCUMENTS 597994 4/1978 Switzerland .

*Primary Examiner*—Douglas D. Watts
*Assistant Examiner*—Paul M. Heyrana, Sr.
*Attorney, Agent, or Firm*—Klarquist, Sparkman, Campbell, Leigh & Whinston

[57] ABSTRACT

In tools for clipping material of different hardness and dimensions, there are required blade-portions (1, 2) having different characterics. A pliers jaw, the blade-portion of which is formed with different edge angles ($a\alpha_1$, $\alpha_2$), different edge radii and different widths (b, B) on its outer chamfer surface (5) results in a tool which is usable for different materials. By configuring different cutting areas (6, 7) by distinctly machining the jaw, the right cutting area can easily be localized for the material in question that is to be cut.

6 Claims, 1 Drawing Sheet

PLIERS JAWS FOR CUTTING MATERIALS WITH DIFFERENT HARDNESS AND DIMENSIONS

TECHNICAL FIELD

The present invention relates to a pliers jaws intended for cutting materials of different hardnesses and of different dimensions. A jaw of the pliers comprises with two blade portions, of which at least one is provided with a cutting edge having an edge angle at one end of the jaw which is less than this angle at the opposite end.

BACKGROUND ART

In cutting pliers of the traditional kind, the pliers jaw has edges which can be generally regarded as pointed, or in any case as only having an extremely small edge radius. This radius is unchanged along the entire length of the edge. The edge angle of the blade-portion is similarly unchanged along the entire length of the edge, from the tip of the jaw towards the joint, and this also applies to the width of the outer chamfer on the jaw. Such cutting pliers of a traditional kind are described, e.g. in the U.S. Pat. No. 2,990,735, the known pliers being also provided with a recess for stripping coated wire.

A disadvantage with such known pliers is that they have maximum utility solely for wire or rod within a narrow dimensional range and degree of hardness.

Cutting tools of the scissors type are also known in the art, as will be apparent from the Swiss Patent No. 597 994, and are intended for all round purposes, i.e. the tool should be able to be used for cutting both paper as well as hard material such as metal. For this purpose, at least one of the scissors blades has been formed with a progressively increasing edge angle from the tip of the tool towards the joint.

The known scissors tool with its pointed scissors cutting edges is not suitable for cutting wire-shaped material, which gives a heavily concentrated application of force to the edges. Although the inward part of the cutting blade with its larger cutting edge angle, situated closer to the scissors joint, is intended for cutting harder material, wire-shaped material could easily give rise to pitting damage on the scissors edges.

DISCLOSURE OF THE INVENTION

The object of the present invention is to provide a pliers jaw suitable for cutting material with different dimensions and different degrees of hardness. Such a pliers jaw has its use in connection with cutting tools which are pneumatic, hydraulic or electrical power units just as well as with pure manual cutting tools of the pliers type, such as side cutters. Instead of needing to use, as at present, different jaws for material with different degrees of hardness, there is achieved in accordance with the present invention a pliers jaw which is generally utilizable for material with different properties.

This is achieved in accordance with the present invention by the jaw of the implementation disclosed in the introduction having at least one of its blade-portions formed with a rounded edge, the radius of the rounding being small at one end of the jaw and greater at its other end. In addition, the width of the outer chamfered surface of the edge is small at the one end and greater at the opposite end.

With a side cutter, for example, having jaws in accordance with the invention, it will be possible to cut soft wire at the tip of the cutter, where the combination of small edge radius, small edge angle and small chamfer width have been found to give the correct conditions for cutting soft wire, while the combination of larger edge radius, larger edge angle and larger chamfer width have been found to provide maximum conditions for cutting harder material.

By forming one or both blade-portions of the pliers jaw with two or more well-defined cutting areas, each being allotted its own edge angle, the person using the tool can easily decide within which area material of known hardness shall be cut. For example, with a side cutter formed with jaws in accordance with the invention, the operator can easily see how far in towards the joint the wire in question shall be taken for optimum cutting conditions to prevail when the hardness of the wire is known.

PREFERRED EMBODIMENT

A preferred embodiment of the pliers jaw in accordance with the present invention will now be described in connection with a side cutter and with reference to the accompany drawings, where FIG. 1 is a front view of a side cutter formed with jaws in accordance with the invention, and provided with two defined cutting areas;

The following detailed description of a preferred embodiment of the pliers jaw in accordance with the invention is made in connection with a manually used side cutter. It should be emphasized, however, that jaws of this embodiment can also be used in connection with pneumatically, hydraulically or electrically driven cutting tools. The jaws in accordance with the invention can also be exchangeable in such cases.

Figure 1:
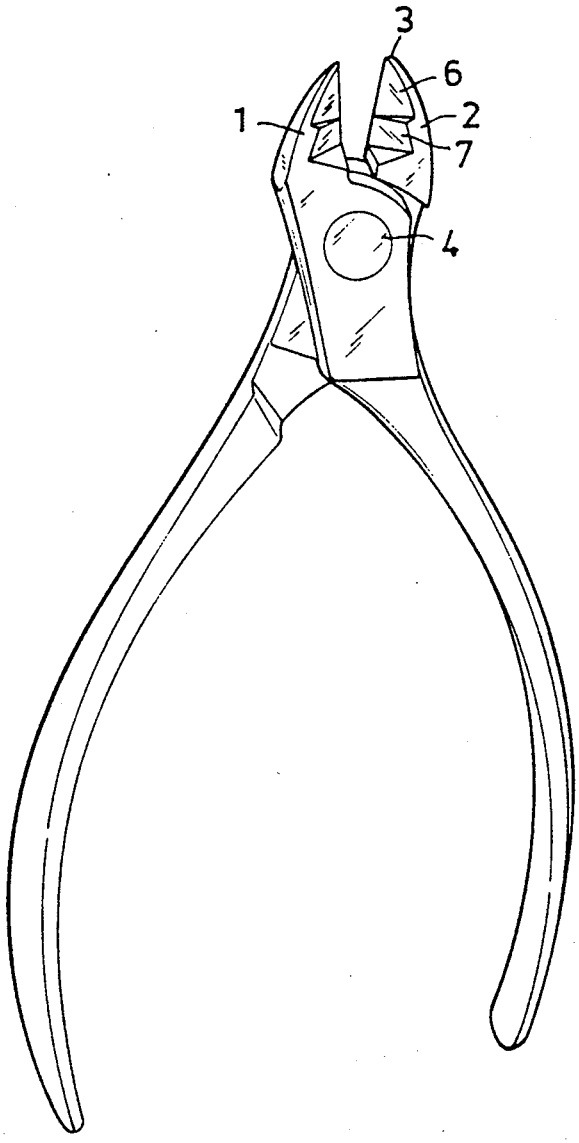

In FIG. 1, there is shown a side cutter, the legs of which are conventionally pivotably connected to each other by a joint 4. The legs are formed into jaws between the joint 4 and the tip 3 of the cutter. The jaws have blade-portions 1 and 2.

Figure 2:
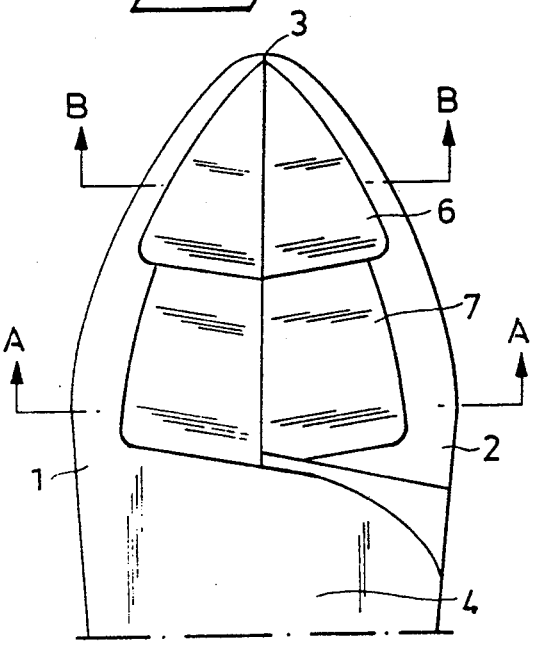
FIG. 2 illustrates the jaws of the side cutter in FIG. 1 to a larger scale.

As will be seen from FIG. 2, the jaws in the illustrated embodiment are divided into two cutting areas 6 and 7. These are defined primarily by pronounced machined sections, which together give a traditional fir-tree configuration. The cutting areas 6 and 7 can further be given different colour markings for the tool user quickly to localize the right cutting area.

The cutting area 6 is intended for material with less hardness and/or lighter gauge dimensions, while the cutting area 7 closest to the joint 4 is intended for material with greater hardness and/or heavier gauge. For meeting requirements of maximum cutting or clipping ability of the respective material dimension, the different cutting areas 6, 7 have been formed in accordance with the invention with edges having different combinations of characteristics.

Figure 3:
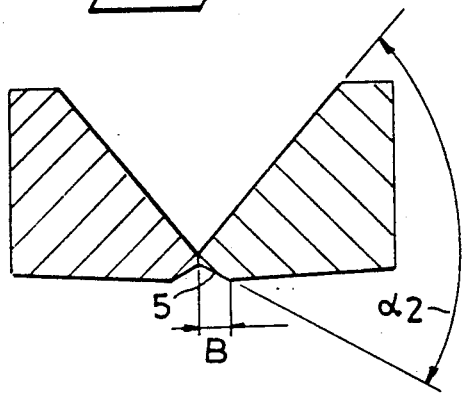
FIGS. 3 and 4 are sections A—A and B—B according to FIG. 2 for illustrating the different edge angles.
Figure 4:
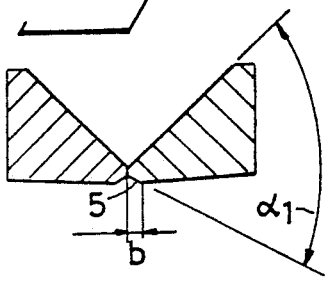
Figure 5:
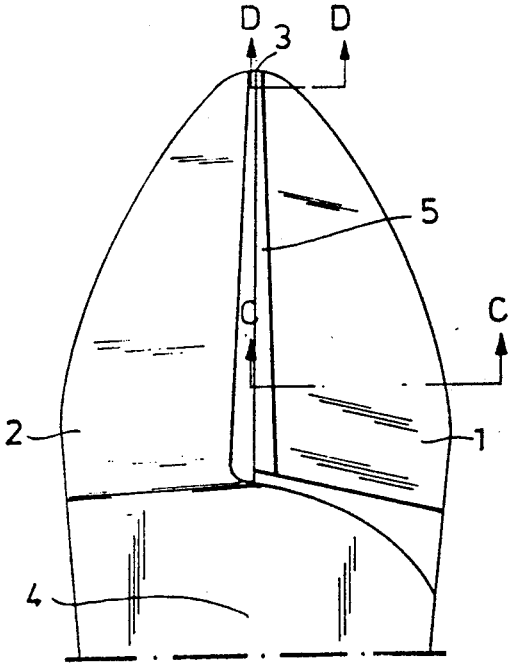
FIG. 5 shows the back of the pliers according to FIG. 1, for clearly showing the width conditions of the outer chamfered surfaces.
Figure 6:
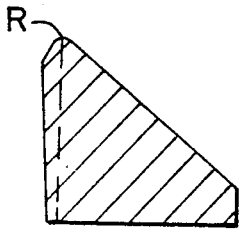
FIGS. 6 and 7 are sections C—C and D—D according to FIG. 5 for illustrating the edge radii.
Figure 7:
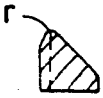

The cutting area 6 for soft and/or light gauge material has an edge with an angle $\alpha_1$ (FIG. 4) which is small and with a radius r (FIG. 7) and width b (FIG. 4) which is small on the part of the outer chamfer surface 5 pertaining to this cutting area 6. A corresponding characteristic combination for the edge of the cutting area 7 to be used for hard and/or heavier gauge material will be seen from FIGS. 3 and 6. Within the cutting area 7, the edge has a large edge angle $\alpha_2$, large radius R and a large width B on the outer chamfer surface 5.

For a hand tool such as a side cutter, the edge angle $\alpha_1$ varies between 30°–90° and the edge angle $\alpha_2$ between 90°–120°. The edge angle $\alpha_1$ is preferably 85° and the edge angle $\alpha_2$ is 90°. The given dimensions as well as the remaining characteristics for the edges depend, however, on the material which is to be cut or clipped and which can be made progressively increasing from one end (the tip 3 of the pliers) towards the other end (the joint 4). The edge radius r–R is within the range 0–2.0 mm and the width b–B of the chamfer surface 5 within the range 0–5 mm.

Although the blade-portions 1, 2 of the plier jaws in the preferred embodiment has been given mutually corresponding characteristic combinations, it would be conceivable solely to form one blade-portion 1 or 2 in the mentioned manner. It is also within the scope of the invention to form the jaw with more cutting areas than the two 6, 7 shown on the accompanying drawings and described in detail above. In this way, there is achieved more accurately defined material cutting areas to aid the tool user. The pliers jaw defined above in connection with the drawings must therefore not be regarded as limiting the invention and the scope thereof includes other further developments, with respect to manual hand tools as well as pliers jaws for penumatic, hydraulic or electrical power units falling within the scope of the Claims attached hereto.

We claim:

1. Pliers jaws intended for cutting material with different hardness and different dimensions each plier jaw comprising two blade-portions, each blade portion having two cutting areas with in lined first and second ends and a cutting edge subtending an angle along one edge of each cutting area involving the combination of:

(a) at least the cutting edge angle ($\alpha_1$) of the first cutting area is different to the cutting edge angle ($\alpha_2$) of the second cutting edge area;

(b) at least one blade-portion has a rounded cutting end having a radius of small (r) at said first end and a greater radius (R) at the second end; and (c) the cutting edge at said first end having an outer chamfer surface width (b) being small compared to the corresponding outer chamfer surface width (B) at the second end of the cutting area.

2. Plier jaws as claimed in claim 1, characterized in that both the rounded edge radius (r, R) and the width (b, B) of the chamfer surface progressively increases from said one end (3) towards the other end (4).

3. Plier jaws as claimed in claim 1, characterized in that it is divided into two cutting areas (6, 7), each of which is allotted its own edge angle ($\alpha_1$, $\alpha_2$) the cutting area (6) at one end (3) of the jaw having the least edge angle ($\alpha_1$).

4. Plier jaws as claimed in claim 3, characterized in that the edge angle ($\alpha_1$, $\alpha_2$) progressively increases within each cutting area (6, 7) in a direction from one end (3) to the other end (4) and preferably so that the edge angle has a smooth transition from cutting area to cutting area.

5. Plier jaws as claimed in claim 3, characterized in that both blade-portions (1, 2) have mutually corresponding configurations within the cutting areas (6, 7).

6. Plier jaws, characterized by jaws according to any one of the preceding claims, wherein said first end (3) of the jaws preferably being situated at the end of the cutting edges, while the opposite end (4) is situated in the immediate vicinity of the pliers joint.

* * * * *

UNITED STATES PATENT AND TRADEMARK OFFICE

CERTIFICATE OF CORRECTION

PATENT NO. : 5,033,195

DATED : July 23, 1991

INVENTOR(S) : Rolf Appelkvist; Hans Bergstrom; Lars Erlandsson

It is certified that error appears in the above-identified patent and that said Letters Patent is hereby corrected as shown below:

Title page, item [56]:
In the references cited, "898,496 9/1980 Mullenbach...7/133" should be --898,496 9/1908 Mullenbach...7/133--;

Column 3, line 37, after "dimensions" insert a comma --,--;

Column 4, line 8, after "end" insert a comma --,--;

Column 4, line 11, "(b)" should be --(f)--;

Column 4, line 12, "(B)" should be --(b)--;

Column 4, line 14, "Plier" should be --Pliers--;

Column 4, line 18, "Plier" should be --Pliers--;

Column 4, line 23, "Plier" should be --Pliers--;

Column 4, line 29, "Plier" should be --Pliers--; and

Column 4, line 32, "Plier" should be --Pliers.

Signed and Sealed this

Twentieth Day of October, 1992

*Attest:*

DOUGLAS B. COMER

*Attesting Officer*

*Acting Commissioner of Patents and Trademarks*